US006620304B1

(12) United States Patent
Hoffacker

(10) Patent No.: US 6,620,304 B1
(45) Date of Patent: Sep. 16, 2003

(54) BATH SYSTEM FOR GALVANIC DEPOSITION OF METALS

(76) Inventor: Gerhard Hoffacker, Riedstr. 23, 73553 Alfdorf (DE)

( * ) Notice: Subject to any disclaimer, the term of this patent is extended or adjusted under 35 U.S.C. 154(b) by 0 days.

(21) Appl. No.: 09/980,627

(22) PCT Filed: Jun. 8, 2000

(86) PCT No.: PCT/EP00/05287

§ 371 (c)(1),
(2), (4) Date: Dec. 4, 2001

(87) PCT Pub. No.: WO00/79030

PCT Pub. Date: Dec. 28, 2000

(30) Foreign Application Priority Data

Jun. 19, 1999 (DE) ..... 199 28 047

(51) Int. Cl.[7] ..... C23C 16/00; C25D 3/00; C25D 3/46; C25D 3/62; C25D 3/48

(52) U.S. Cl. ..... 205/238; 205/261; 205/247; 205/263; 205/255; 205/257; 205/259; 205/264; 205/265; 205/267; 106/1.12; 106/1.22; 106/1.25

(58) Field of Search ..... 205/238, 261, 205/247, 263, 255, 257, 259, 264, 265, 267; 106/1.12, 1.22, 1.25

(56) References Cited

U.S. PATENT DOCUMENTS

| | | | | |
|---|---|---|---|---|
| 4,406,755 A | | 9/1983 | Morrissey | 204/47 |
| 4,673,472 A | * | 6/1987 | Morrissey et al. | 204/44.6 |
| 6,251,249 B1 | * | 6/2001 | Chevalier et al. | 205/80 |

FOREIGN PATENT DOCUMENTS

| | | |
|---|---|---|
| DE | 3805627 | 9/1989 |
| WO | 9207975 | 5/1992 |

* cited by examiner

*Primary Examiner*—Edna Wong
(74) *Attorney, Agent, or Firm*—Roylance, Abrams, Berdo & Goodman, LLP

(57) ABSTRACT

A bath system for galvanic deposition of metals includes a solution containing at least one metal, especially a precious metal and/or precious metal alloy in the form of a water-soluble salt, at least one water-soluble protein material or amino acid and/or at least one water-soluble sulfonic acid, at least one water-soluble nitro-containing substance, at least one water-soluble surface-active agent and at least one vitamin. The bath system galvanostatically applies high quality layers with uniform quality. The bath system can be kept free of harmful substances such as cyanides, sulfites and hard complexing agents.

21 Claims, No Drawings

BATH SYSTEM FOR GALVANIC DEPOSITION OF METALS

FIELD OF THE INVENTION

The invention relates to a bath system for the galvanic deposition of metals onto a metal substrate.

BACKGROUND OF THE INVENTION

Galvanic baths for the deposition of precious metals and precious metal alloys have long been known for use in the field of decorative arts and also in technical fields. The soluble precious metal compounds which are used predominantly are in the form of a cyanide compound (potassium gold cyanide, potassium silver cyanide), a sulfite base (gold sulfite compound), or contain ammonium (palladium compounds). The complexing and stabilizing of the systems select either an excess of the salts builders (cyanide, sulfite), or ammonium as well as the so-called hard complex builders (derivatives of amino-or nitriloacetic acids etc.) or combinations of these.

Systems which contain cyanide are generally known and appreciated for their stability even with complicated and aggravated conditions of use. However, the toxicity of cyanide compounds are considerable sources of danger. Since a considerable interest exists in the use of the dangerous cyanide, continuous efforts and experimentation have been carried out in the area of precious metal baths.

The use of sulfite gold baths and thiosulfate in silver baths has already been described. These systems, however, involve great difficulties with respect to the stability of the bath. Sulfite in complex solutions initiates automatic reduction of precious metals, such as for example gold. Thiosulfate in silver baths on account of the lower complexing strength cannot prevent photochemical reactions of free silver ions. The addition of complex builders to the bath, such as ethylene diamine tetraacetic acid or nitrilotriacetic acid or their derivatives, can indeed slow down the photochemical reaction process but cannot prevent it. Careful control of the working pH level is required, so that a remarkably higher outlay is required with the processing of rinsing and flushing waters and applied baths. The use of a gold sulfite complex is disclosed in German Patent DE-OS-38 05 627, whereby health-endangering pyridine compounds as well as the nerve poison antimony are added to the bath as additional component parts.

All of the bath systems known at this time, and accessible to the expert with knowledge in the art, which were and are operated using replacement materials instead of cyanide, have not come into technical use on account of the difficult handling involved with these baths. Thus WO 92/07975 discloses the use of aminoacetic acid and special glycine as complex builders for palladium and/or silver. However, such a bath solution, which is a costly metal deposition using the so-called potentiostatic deposition method, is not comparable with the traditionally used deposition method referred to as the galvanostatic method. Potentiostatic deposition demands unconditionally a deposition of anolyte and catholyte using a membrane, so that this known method cannot be used for continuous industrial processes. In addition, the use of glycine alone in and of itself with a galvanostatic bath method would also not lead to the desired results.

SUMMARY OF THE INVENTION

The invention is directed to aqueous bath systems for galvanic deposition of metals, particularly of precious metals and their alloys, which in accordance with a stable working method are suitable both for decorative and also for technical use. The process of the invention facilitates the application of high quality coatings which remain at the same high quality during the galvanostatic working processes, and where the bath system is free of harmful materials, such as cyanides, sulfites and hard complex builders. Furthermore, the number of salt builders required for complexing of the individual metals is retained as low as possible.

The disadvantages of the prior baths are overcome by the bath system that includes

- at least one metal, particularly a precious metal and/or a precious metal alloy in the form of a water-soluble salt, and
- at least one water-soluble protein, and/or
- at least one water-soluble sulfonic acid, and
- at least one water-soluble nitrO-containing material, and
- at least one water-soluble surfactant, and
- at least one vitamin.

DETAILED DESCRIPTION OF THE INVENTION

The bath of the invention is a highly effective, stable working deposition system, which can be maintained free of cyanides, sulfites and hard complex builders. The bath system of the invention can be used ecologically. The bath system of the invention also meets the highest requirements for environmental quality and waste disposal.

Therefore, the bath system of the invention facilitates the addition of different alloyed metals so that a broad spectrum of alloy compositions can be attained. The bath system is characterized by the high quality of the deposition layers with simple maintenance of the bath. Furthermore, high current outputs are also possible, so that the amount of energy used can be reduced thereby reducing the operating costs. The bath system according to the invention is not noticeably dependent upon fluctuations of the component parts of the bath and the bath can easily be filled according to the individual requirements by means of suitable additives. Furthermore, the bath system has a long life.

Preferably, protein amino acids with their derivatives and their salts are used as a supply for the protein materials, as well as additional or alternative sulfonic acids with their derivatives and their salts.

The aforementioned protein amino acids in the molecule in addition to one or more amino groups can also include one or more mercaptol groups. Examples of such protein amino acids are glycine, alanine, cysteine and methionine.

The sulfonic acids can contain one or more alkyl groupings and/or one or more amino groupings in the molecule. Examples of such sulfonic acids are amidosulfonic acid, methansulfonic acid and ethane sulfonic acid.

For the stabilizing and complexing of the bath system, particular water-soluble nitro-containing compounds have been proven favorable as acids and/or their derivatives and/or their salts. The cited nitro-containing compounds can include at least one nitro group, one carbonic acid radical and/or one sulfonic acid radical. Examples for such nitro-acids are 3-nitrophthalic acid, 4-nitrophthalic acid and/or m-nitrobenzene sulfonic acids.

Water-soluble nitrogen containing compounds such as acids and/or their derivatives and/or their salts can be used for further stabilization of the system. The nitrogen containing compounds to be used contain at least one amino group and/or one carbonic acid radical and/or sulfonic acid radical. Some examples of these nitrate compounds are nicotinic acid, its derivatives and/or salts and/or succinic acid, its derivatives and/or its salts, preferably its amino or sulfo compounds.

Materials that have proven particularly advantageous as surfactants are water-soluble derivatives of succinic acid (Bernstein acid), namely its ester. Particularly, nicotinic acid amide is used as vitamin group, the nicotinic acid amide added to the vitamin B complex, particularly to vitamin B3.

Sulfone derivatives which are suitable for the system could be used as polishing or glazing bath builder, which have one or two aromatic radicals on the sulfone group. The core carbon can be partially substituted by metal, nitrate groups, or amino groups as well as halogen.

For an expert in the art it is remarkable that the addition of surfactants as well as vitamins can maintain the otherwise known baths free of harm, particularly free of cyanide. It is also surprising that the surfactants and vitamins provide improved results, particularly increasing the deposition rates with comparable or lower. current output. Therefore, improved surfaces are obtained as compared with the known bath systems, even in relation to their glossiness.

A gold bath designed according to the invention for the deposition of fine gold contains the gold, for example, as protein amino acid derivative of a class a) compound, preferably in the form of a gold-cysteine complex, whereby the gold concentration is between 0.5 and 30 g/l of the bath, preferably between 1 and 10 g/l of the bath. The pH level of the bath can be adjusted between 7 and 14, preferably between 8 and 12, particularly between 9 and 10. The adjustment and stabilization of the pH level can occur by means of a borate buffer, phosphate buffer, citrate buffer or some other buffer systems traditionally used in galvanizing technology. The working temperature of such a bath is adjusted between 20° C. and 80° C., preferably between 40 and 60° C. The usable cathodic current output density is between 0.1 $A/dm^2$ and 15 $A/dm^2$, preferably between 0.5 $A/dm^2$ and 5 $A/dm^2$.

The characteristic gold bath according to the bath system of the invention for the deposition of fine gold contains an excess of the protein amino acid derivatives which are being used, and for the stabilization in addition to the aforementioned sulfonic acids can include one of the nitrogen-containing acids which is indicated and/or in addition a water-soluble nitrogen-containing compound. This water-soluble nitrogen-containing compound, in addition to the complexing of the gold in a wide pH range, presumably if necessary can undertake the complexing of the alloy metals which are present. The additional water-soluble nitrogen-containing compound preferably includes at least one heterocyclic organic compound. This heterocyclic organic compound can preferably consist of aromatic heterocyclic compounds. Amides of nicotinic acid have been shown to be particularly advantageous. As additional stabilizing medium, amides of succinic acid can also be added.

A silver bath produced according to the invention for the deposition of fine. silver includes the silver, for example, as sulfonate of the class b) compound, preferably in the form of silver methane sulfonate. The silver concentration is between 0.5 and 60 g/l of the bath, preferably between 2 and 40 g/l of the bath. For stabilization, the bath can include additional component portions of the sulfonate. For complexing of the free silver and for protection against photometric reaction, the bath of the invention includes at least one water-soluble protein amino acid compound which is a class a) compound. The water-soluble protein amino acid compound is present in excess of the stoichiometric ratio to the silver.

For further stabilization of the bath, at least one additional water-soluble organic nitro-containing compound can be added to the bath system of the invention. This water-soluble nitro-containing compound preferably can undertake the complexing of alloy metals which are present in addition to the complexing of the silver in a wide pH range if it is called for. The added water-soluble nitro-containing compound preferably has at least one heterocyclic organic compound. This heterocyclic organic compound can preferably be an aromatic heterocyclic compound. The amides of nicotinic acid has been found to be particularly advantageous. For additional stabilization in terms of an amide, the amide of succinic acid can also be added.

The pH level of the bath can be adjusted to between 7 and 14, preferably between 8 and 12, particularly between 9 and 10. The adjustment and stabilizing of the pH level can be carried out with a borate buffer, phosphate buffer, citrate buffer or some other buffer used in the traditional buffer systems in galvanizing technology. The working temperature of such a bath is between 10° C. and 50° C., preferably between 20° C. and 40° C. The usable cathodic current density can be adjusted to between 0.1 $A/dm^2$ and 15 $A/dm^2$, preferably between 0.5 $A/dm^2$ and 5 $A/cm^2$.

It is particularly advantageous that substrates of brass can be coated directly in the silver baths of the invention. The preliminary silver coating of brass substrates in silver baths, which are required in the prior processes can be avoided. Alloy metals can be added to the baths according to the invention for deposition of fine coatings of precious metals. All known metals of the periodic table can be used as alloy metals, which can be deposited together with the relevant precious metal out of an aqueous solution. Particularly, these are the aforementioned precious metals: gold, silver, palladium and combinations of these same precious metals arranged one over the other. Preferably, copper, zinc, tin, iron and bismuth are suitable as alloy metals for gold. Tin and bismuth have proven particularly advantageous in their use as alloy metals for silver.

According to the baths of the invention using alloy depositions, the individual alloy partner can be galvanically deposited by enrichment or by depletion in the baths into portions of between 1 and 100%.

Hereinafter relative to two exemplary embodiments, the aqueous system having few or no harmful components for the galvanic deposition of precious metals and precious metal alloys is introduced.

The bath component parts in the following examples were dissolved in the given quantities and the solution filled with deionized water up to 1 liter. Using the bath parameters given in the individual examples, test pieces were coated with the corresponding metal and/or metal alloy.

| Bath 1: |
|---|
| 2 g/l gold as gold-cysteine-complex |
| 5 g/l methane sulfonic acid solution (70%, neutralized with potassium hydroxide solution) |
| 5 g/l cysteine |
| 20 g/l borax |
| 2 g/l 3-nitrophthalic acid |

-continued

| Bath 1: | |
|---|---|
| 20 | g/l succinic acid sulfamide |
| 5 | g/l nicotinic acid amide (vitamin) |
| 1 | ml/l Tegotain 485 (commercial surfactant, 1% aqueous solution) |
| 0.1 | ml/l gloss builder (commercial sulfone derivative, 1% aqueous solution) |
| temperature: 50–60° C. | |
| pH level: 9.5–10.5 | |
| current density: about 0.5 A/dm$^2$ | |
| anodes: platinum-coated titanium | |
| test piece: sections of silver-coated brass sheet, bent | |

The test pieces are coated over the entire surface. The color of the metal coating corresponds to the typical fine gold color.

| Bath 2: | |
|---|---|
| 10 | g/l silver as silver methane sulfonate |
| 5 | g/l methane sulfonic acid solution (70%, neutralized with potassium hydroxide solution) |
| 5 | g/l cysteine |
| 20 | g/l borax |
| 2 | g/l 2-nitrophthalic acid |
| 25 | g/l nicotinic acid amide (vitamin) |
| 3 | ml/l Tegotain 485 (commercial surfactant, 1% aqueous solution) |
| 0.1 | ml/l gloss builder (commercial sulfone derivative, 1% aqueous solution) |
| temperature: 25–30° C. | |
| pH level: 9.5–10.5 | |
| current density: about 1 A/dm$^2$ | |
| anodes: fine silver | |
| test piece: sections of brass sheet, bent | |

The test pieces are coated over the entire surface. The color of the metallic coating corresponds to the typical fine silver color.

While various embodiments have been chosen to illustrate the invention, it will be understood by those skilled in the art that various changes and modifications can be made therein without departing from the scope of the invention as defined in the appended claims.

What is claimed is:

1. A bath for the galvanic deposition of metals, said bath containing:

at least one metal salt or metal alloy salt in an aqueous solution, at least one component selected from the group consisting of a water-soluble protein material, a water-soluble sulfonic acid, and mixtures thereof, at least one water-soluble nitro-containing compound, at least one water-soluble surfactant, and at least one vitamin.

2. The bath of claim 1, wherein said protein material is an amino acid and is present as an acid, salt or derivative thereof, and is present in an amount of 0.1 to 150 g/l of the bath.

3. The bath of claim 1, where said sulfonic acid is present as an acid, acid derivative, salt, or mixture thereof in a an amount of 0.1 to 200 g/l of the bath.

4. The bath of claim 3, a further comprising a water-soluble sulfone derivative as a gloss medium in a an amount of 0.001 to 5 g/l of the bath.

5. The bath of claim 1, wherein said water-soluble nitro-containing compound is present as an acid, acid derivative, salt or mixture thereof in an amount of 0.1 to 200 g/l of the bath.

6. The bath of claim 1, wherein water-soluble surfactant is present in an amount of 0.1 to 5 g/l of the bath.

7. The bath of claim 1, wherein said vitamin is nicotinic acid amide.

8. The bath of claim 1, further comprising a buffering agent and where said bath has a pH of 7 to 14.

9. The bath of claim 1, wherein said at least one metal is gold and where said bath has a gold concentration of 0.5 to 30 g/l of the bath.

10. The bath of claim 9, wherein said bath has a gold concentration of 1 g/l to 10 g/l.

11. The bath of claim 1, wherein said at least one metal is silver and where said bath has a silver concentration of 0.5 to 60 g/l of the bath.

12. The bath of claim 11, wherein said bath has a silver concentration of 2 gl to 40 g/l.

13. The bath of claim 1, wherein said metal salt is a precious metal salt.

14. The bath of claim 1, wherein said metal alloy salt is a precious metal alloy salt.

15. The bath of claim 1, wherein said metal is selected from the group consisting of gold, silver, palladium, and mixtures thereof.

16. The bath of claim 1, wherein said nitro-containing compound is selected from the group consisting of 3-nitrophthalic acid, 4-nitrophthalic acid, m-nitrobenzene sulfonic acid, and mixtures thereof.

17. The bath of claim 1, wherein said water-soluble nitro-containing compound is present in an amount of 0.1 g/l to 50 g/l.

18. The bath of claim 1, wherein said bath has a pH of 8 to 12.

19. The bath of claim 1, wherein said protein material is an amino acid selected from the group consisting of glycine, alanine, cysteine, and methionine.

20. The bath of claim 1, wherein said vitamin is a Vitamin B complex.

21. The bath of claim 1, wherein said bath further comprises borax.

* * * * *